US009309624B2

(12) United States Patent
Straub et al.

(10) Patent No.: US 9,309,624 B2
(45) Date of Patent: Apr. 12, 2016

(54) LAMINATED ENDLESS BELT

(71) Applicant: Voith Patent GmbH, Heidenheim (DE)

(72) Inventors: Michael Straub, Steinheim (DE); Robert Eberhardt, Ellwangen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/029,448

(22) Filed: Sep. 17, 2013

(65) Prior Publication Data

US 2014/0014285 A1 Jan. 16, 2014

Related U.S. Application Data

(63) Continuation of application No. PCT/EP2012/054347, filed on Mar. 13, 2012.

(30) Foreign Application Priority Data

Mar. 17, 2011 (DE) ..... 10 2011 005 673

(51) Int. Cl.
*D21F 1/10* (2006.01)
*D21F 7/08* (2006.01)
(Continued)

(52) U.S. Cl.
CPC ..... *D21F 1/80* (2013.01); *D21F 1/0036* (2013.01); *D21F 1/0054* (2013.01)

(58) Field of Classification Search
CPC ..... D21F 1/10; D21F 1/105; D21F 1/12; D21F 1/14; D21F 1/0027; D21F 1/0036; D21F 1/0054; D21F 1/0081; D21F 1/80; D21F 3/02; D21F 7/08; D21F 7/083; D21F 7/10; D21F 7/12; B29C 53/56; B29C 53/58; B29C 53/78; B29C 53/48; B29C 53/38; B32B 7/005; B32B 7/04; B32B 7/12; B32B 5/22; B32B 5/24; B32B 5/26
USPC ..... 162/358.1, 358.2, 358.4, 900–904, 348, 162/306, 361, 362; 28/110, 142; 139/383 A, 139/383 AA, 425 A; 156/166, 169, 173, 176, 156/178, 180–182; 34/95; 428/57, 58
See application file for complete search history.

(56) References Cited

U.S. PATENT DOCUMENTS 4,541,895 A 9/1985 Albert
5,202,170 A * 4/1993 Hsu et al. ..... 428/48
(Continued)

FOREIGN PATENT DOCUMENTS

CA 1 230 511 12/1987

OTHER PUBLICATIONS

Communication via the Transmission of the International Search Report and the Written Opinion of the International Searching Authority or the Policy dated Feb. 1, 2013 for International Application No. PCT/EP2012/054347 (10 pages).

*Primary Examiner* — Eric Hug
(74) *Attorney, Agent, or Firm* — Taylor IP, P.C.

(57) ABSTRACT

A fabric for a papermaking machine is in the form of an endless belt which is closed in the circulating direction. The fabric has a first layer and a second layer which is arranged on the first layer. Each layer is formed by one or by a plurality of film-shaped tapes which adjoin one another and are arranged next to one another in the direction transversely with respect to the circulating direction. The side edges, which adjoin one another, of two film-shaped tapes of one of the two layers are arranged between the side edges of the two layers are arranged between the end edges of adjoining end edges of film-shaped tapes of one of the two layers. The film-shaped tapes of one of the two layers are connected over their full area to the film-shaped tapes of the other of the two layers.

10 Claims, 6 Drawing Sheets

(51) Int. Cl.

| | |
|---|---|
| ***D21F 7/12*** | (2006.01) |
| ***D21F 1/80*** | (2006.01) |
| ***D21F 1/00*** | (2006.01) |

(56) References Cited

U.S. PATENT DOCUMENTS

| | | | | | |
|---|---|---|---|---|---|
| 5,360,656 | A * | 11/1994 | Rexfelt et al. | ..... | 428/193 |
| 5,864,931 | A * | 2/1999 | Best et al. | ..... | 28/110 |
| 6,565,713 | B2 * | 5/2003 | Hansen et al. | ..... | 162/358.2 |
| 6,699,366 | B2 * | 3/2004 | Paquin et al. | ..... | 162/358.2 |
| 6,723,208 | B1 * | 4/2004 | Hansen | ..... | 162/358.2 |
| 6,875,315 | B2 * | 4/2005 | Bakken et al. | ..... | 162/362 |
| 6,998,023 | B2 * | 2/2006 | Crook | ..... | 162/358.2 |
| 7,135,094 | B2 * | 11/2006 | Watanabe et al. | ..... | 162/358.2 |
| RE39,709 | E * | 7/2007 | Fekete et al. | ..... | 162/358.2 |
| 2007/0134467 | A1 | 6/2007 | Sayers | | |
| 2010/0230064 | A1 * | 9/2010 | Eagles et al. | ..... | 162/289 |
| 2011/0250355 | A1 | 10/2011 | Allum et al. | | |

* cited by examiner

LAMINATED ENDLESS BELT

CROSS REFERENCE TO RELATED APPLICATIONS

This is a continuation of PCT application No. PCT/EP2012/054347, entitled "LAMINATED ENDLESS BELT", filed Mar. 13, 2012, which is incorporated herein by reference.

BACKGROUND OF THE INVENTION

1. Field of the Invention

The current invention relates to clothing for paper machines and relates in particular to non-woven clothing and to the manufacture of same.

2. Description of the Related Art

Paper machines are utilized for the production of fibrous webs, for example different types of papers, cartons, cardboards and similar nonwovens. In this document the term "paper" is representative for these types of fibrous webs.

The production of a fibrous web starts in the forming section of a paper machine with the deposit of a fibrous stock suspension on clothing, or respectively with the introduction of a fibrous stock suspension into the gap which is formed between two clothings. As a rule, clothing is in the embodiment of endless belts which, rerouted over rollers, rotate within a certain section of the paper machine. The paper-side surface of the clothing carries the fibrous suspension, or respectively the fibrous web or fibrous nonwoven web resulting from dewatering. The surface of the clothing running over the rolls is referred to below as the running-side surface. The clothing is equipped with passages through which water is drawn from the paper-side surface to the running surface.

Clothing currently used in the forming section of paper machines as forming fabric consists of woven material. Woven clothing features uniform structures with a repeat basic pattern. The forming fabrics are generally composed of several woven layers having different thread sizes and thread directions. Because of their different weave structures, the individual layers of such clothing not only have water permeability differing from each other but, since the openings or passages in the paper-side layers are regularly covered by threads of woven layers arranged beneath them also lead to laterally local variations in permeability of the forming fabric. Since a laterally varying permeability results in locally varying dewatering velocity of the fibrous web, visible markings in the fibrous web or paper web with a uniform arrangement following the weave pattern are the result. Since lesser dewatered regions in a web also have a lower fiber density, lateral permeability fluctuations moreover compromise the paper quality also through this effect.

Woven types of clothing have a lesser flexural strength and therefore are often prone to crease formation during rotation through the machine. The use of monofilaments of various materials, for example a combination of yarns consisting of polyethylene terephthalate (PET) and polyamide (PA) on the running side of a clothing leads to protruding or curling of forming fabric edges, due to the different characteristics of these materials in regard to water absorption, expansion, etc.

Since clothing cannot be woven as an endless belt, both ends of a continuously long woven belt must be joined with each other in order to form an endless belt. In order to avoid irregularities at the joint location which would lead to marking of the web, the connection is made through a complicated woven seam structure, whereby the ends of warp and weft threads allocated to each other are spliced together at the connection location of the woven belt, offset according to a certain pattern. This joining technique is very complex and is reflected in accordingly high production costs for woven endless clothings.

As an alternative to woven clothing, types of clothing were suggested which are produced from nonwoven material webs. In international patent specification CA 1 230 511 and U.S. Pat. No. 4,541,895 an example of a clothing is cited which is formed from a laminate of several layers of nonwoven, water-impermeable materials into which openings are introduced for the purpose of dewatering. Joining of the individual layers of the laminate occurs, for example through ultrasonic welding, high frequency welding or thermal welding. The dewatering holes are introduced into the laminate preferably by means of laser drilling. The welded seam of one layer can be arranged offset to that of the other layers, whereby the welded seams moreover can be arranged at an angle to the direction of travel of the endless belt in order to avoid visible thickening of the clothing. However, to produce such film laminates in the dimensions necessary for forming fabrics is very expensive. Such multilayer film laminates are moreover very stiff and have a tendency to delaminate under the conditions prevailing during use in the forming section of a paper machine.

If polymer belts are used to produce clothing for paper machines, then these must be drawn in the direction of travel of the clothing. Otherwise the clothing is irreversibly stretched under the tensile stresses prevailing during operation and would therefore become unusable in a very short time. In industrial scale applications of paper machines, clothing having widths of approximately 8 to 12½ meters (m) are typically used. Non-directionally drawn polymer belts are, however, currently only available in widths of typically approximately 1 to approximately 2 meters. Biaxially drawn belts are currently offered at approximately 4 m wide. Therefore, to produce clothing, several laterally adjacent polymer belts must be joined together. In order to produce clothing in the embodiment of an endless belt the ends of the belt must moreover be joined. At the location of the joint the mechanical stability is diminished compared to the full material.

To solve the problem, U.S. Patent Application Publication No. 2010/0230064 suggests clothing for use in paper machines which is produced from a spirally wound polymer ribbon. The width of the polymer ribbon is considerably narrower than the width of the clothing produced therefrom, whereby the longitudinal direction of the polymer ribbon—except for the slanting provided by the winding pitch—is consistent with the direction of travel of the clothing. The side edges located opposite each other of adjoining winding cycles of the polymer ribbon are welded together to form a closed running surface. Since the welded seam is arranged in a relatively small angle to the direction of travel of the clothing, the tensile stress components acting transversely to the welded seam are small, so that in an ideal situation the material in the region of the welded seam is not unduly stressed. The production of clothing from a spirally laid polymer ribbon is however very expensive, since it requires a special welding device, whereby either the welding apparatus has to be guided at high precision several times along the welding line around the clothing or whereby the clothing must be moved with the rotating welding line relative to the welding apparatus. Moreover, the edges of the clothing must be trimmed after the welding process in order to obtain clothing having a uniform width. Consequently, the welded seam encounters one of the side edges of the clothing at a pointed angle, thus providing a weak point for tearing of the clothing, due to the structurally weaker welded seam, compared to the polymer ribbon.

What is needed in the art is a clothing for paper machines which is film-like, has high mechanical stability and tensile strength, is sufficiently wide for use in industrially employed paper machines and which can be manufactured with conventional means.

SUMMARY OF THE INVENTION

The present invention provides a clothing for a paper machine configured in the form of an endless belt which is closed in the direction of rotation and has a first layer and second layer which is arranged on the first layer and which is joined over its entire surface with the first layer. The first and second layer are each formed from one film-like ribbon or from a plurality of film-like ribbons which are arranged adjacent next to one another in a direction transverse to the direction of rotation. A film-like ribbon is hereby to be understood to be a thin monolithic body of limited width compared to its lateral extension.

In particular in the case of wider clothing, the first and second layer are always formed by a plurality of film-like ribbons which adjoin one another and are arranged next to one another in the direction transverse to the direction of rotation. The film-like ribbons of both layers are hereby arranged so that adjoining lateral edges of two film-like ribbons of one of the two layers are arranged between the side edges of one film-like ribbon of the other of the two layers, and adjoining end edges of film-like ribbons of one of the two layers are arranged between the end edges of adjoining film-like ribbons of the other of the two layers.

In this context it is pointed out that terms such as "comprise", "feature", "include", "contain" and "with" as well as their grammatical deviations used in this description and in the claims in order to list characteristics generally indicate a non-exhaustive listing of characteristics, for example of process steps, features, regions, dimensions and similar, and in no way exclude the existence of additional and other features or groupings of other or additional features.

To produce clothing of this type, a method is cited according to the present invention which includes a step for provision of a first film-like ribbon and a second film-like ribbon having the same or approximately the same length and width, whereby at least one of the ribbons is transparent for light in a specific wave length range in the near infrared. In the event that both ribbons are transparent for light in a specific wave length range in the near infrared, a coating is applied onto one of the surfaces of one of the ribbons in an additional step, whereby the coating absorbs light of a wavelength from a specific wavelength range. In a subsequent step, the second film-like ribbon is arranged on the first film-like ribbon so that the two ribbons contact each other in the potentially coated region. In an additional step infrared light is radiated through the film-like ribbon or one of the film-like ribbons which is transparent for the specific wavelength range, onto the region where both ribbons overlap, whereby the wavelength range of the infrared light is consistent with a wavelength which can be absorbed by the absorbing ribbon or coating. The infrared light radiated onto the coating is distributed relative to the ribbons arranged on top of one another in such a way that each region of the contact area which is formed between the two ribbons is melted while pressure is simultaneously exerted upon the melt region.

When using a plurality of film-like ribbons disposed adjacent to each other and adjoining each other in the direction transverse to the direction of rotation, it is feasible to arrange the second film-like ribbon on the first film-like ribbon with a lateral offset, whereby the two ribbons touch each other, for example inside the coated region, if the first and second film-like ribbon are transparent for light in the specific wavelength range. Ultimately several of the film-like ribbons are arranged adjacent to each other and adjoining each other according to the preceding steps and are joined providing a flat effect through analog application of the preceding steps to an endless belt.

According to some embodiments of the clothing according to the present invention, film-like ribbons are utilized consisting of a polymer drawn non-directionally in the direction of rotation of the clothing, or consisting of a bi-directionally drawn polymer. A high dimensional stability is hereby achieved in use according to the present invention.

The film-like ribbons of one of the two layers are materially joined with the film-like ribbons of the other of the two layers in embodiments of the clothing of the present invention. The tensile stress occurring in the intended use of the clothing is hereby completely absorbed by the film-like substrate of the ribbons. In additional embodiments, adjoining lateral edges and/or adjoining end edges of the film-like ribbons are also materially joined, so that no gaps can form at the edges. "Materially joined" is to be understood to be cohesion of the connective partners through atomic or molecular forces.

According to a further embodiment of the clothing according to the present invention a third layer is applied to the paper-side surface of first and second layer. The third layer has a thickness less than that of the first layer and also less than that of the second layer, so that on the one hand a smooth paper-side surface is created and on the other hand the water permeability of the clothing can be laterally varied.

A further embodiment of the clothing according to the present invention can also feature a fourth layer applied to the running-side surface of first or second layer which, for example is optimized for rotation on the rolls of the paper machine. Third and/or fourth layer(s) respectively may contain characteristic-determining additives, whereby in variations thereof, the fourth layer contains, for example wear and tear reducing additives to reduce abrasion of the clothing on the machine elements, in order to achieve a longer serviceable life.

For use in paper machines, the thickness of the clothing is selected, for example from within the range of 300 to 1600 micrometers (μm) or from within the range of 500 to 800 μm.

In order to be suitable for use in paper machines, the film-like ribbons according to an embodiment of the clothing of the present invention are formed on the basis of a material which is selected from of polyethylene terephthalate (PET), polyethylene-naphthalate (PEN), polyphenylene sulfide (PPS), polyetheretherketone (PEEK), polyamide (PA) or polyolefin.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrates embodiments of the invention and such exemplifications are not to be construed as limiting the scope of the invention in any manner.

DETAILED DESCRIPTION OF THE INVENTION

Figure 1:
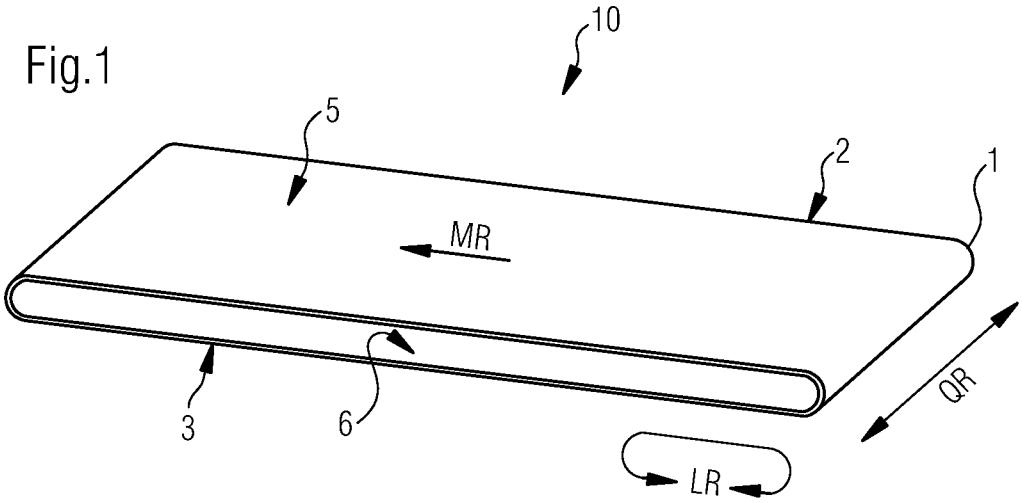
FIG. 1 is a schematic illustration of a clothing in the embodiment of an endless belt according to the present invention.

Referring now to the drawings, and more particularly to FIG. 1, there is shown a schematic illustration of a clothing 10 in the embodiment of an endless belt 1. The width of endless belt 1 is limited by lateral edges 2 and 3. In the direction parallel to the two lateral edges 2 and 3, belt 1 is closed onto itself and is therefore described as an endless belt. The direction in which the endless belt is closed onto itself is referred to as the direction of travel LR, or direction of rotation LR of endless belt 1 or clothing 10. The direction along the shortest connection between lateral edges 2 and 3 is referred to as the cross direction QR. Clothing 10 has a paper-side surface 5 on which the fibrous stock suspension or respectively the fibrous web being formed therefrom is supported in intended use of clothing 10. Paper-side surface 5 of clothing 10 is the surface of clothing 10 facing outward. The surface directed inward, facing the volume enclosed by clothing 10 is identified in this document as running side 6. It is supported on the rolls (not illustrated in the drawings), which cause the rotation of clothing 10. The directions pointing from the running side to the paper-side surface of clothing 10 are referred to below as the vertical direction of clothing 10 or respectively of endless belt 1. Transportation of the fibrous stock suspension or respectively the fibrous web on clothing 10 occurs in the machine direction MR on paper-side surface 5 of clothing 10.

Figure 2:
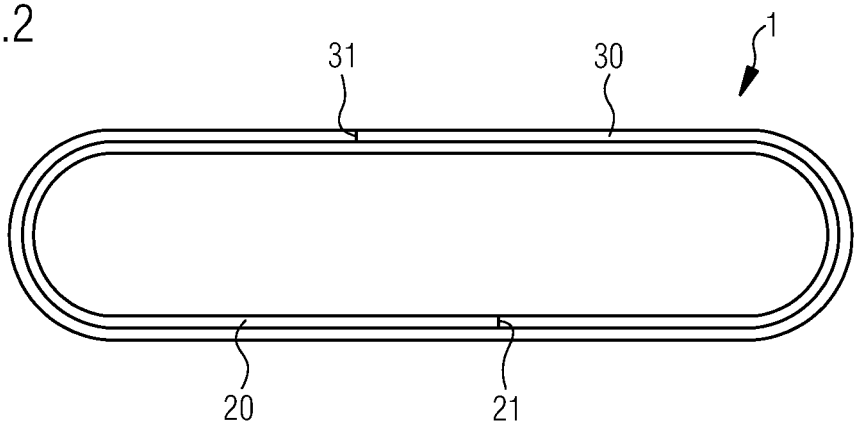
FIG. 2 is a schematic illustration of a cross section through the endless belt of FIG. 1 along a machine direction.

Referring now to FIG. 2, there is illustrated the structure of endless belt 1 according to a first embodiment of the present invention. The belt includes two layers arranged on top of one another, one inner layer 20 and one outer layer 30. The two layers are joined with each other at the contact surfaces. Each of the layers is single-layered relative to the vertical direction of endless belt 1, in other words arranged monolithically, whereby the thickness of each layer is substantially less than length and width of endless belt 1, so that a film-like characteristic of the layers is achieved. The ends of each layer respectively face each other, whereby the thus created butt joint 31 of outer layer 30 is arranged favorably offset in direction of travel LR of endless belt 1, relative to butt joint 21 of inner layer 20 which is formed in the same way, in order to reduce the mechanical load of individual butt joints 21 and 31 during the intended use of the clothing. In FIG. 2 butt joints 21 and 31 are shown as double lines in order to clarify adjoining of the two ends of each layer. This illustration however does not suggest that a gap is created at butt joints 21 and 31 between the ends. The end surfaces rather abut directly against each other and are, for example materially joined with each other.

In the case of narrow endless belts which are currently up to approximately 4 m wide, when using very thin films for the individual layers, currently also to approximately 6 m in width, each of layers 20 or 30 can be formed by one or by a plurality of film-like ribbons which extend over the entire width of endless belt 1. Depending on the length of endless belt 1, the individual layers can be formed by one single film-like ribbon 20 or 30, or by two or a plurality of film elements adjoining each other in the direction of rotation of the belt.

Figure 3:
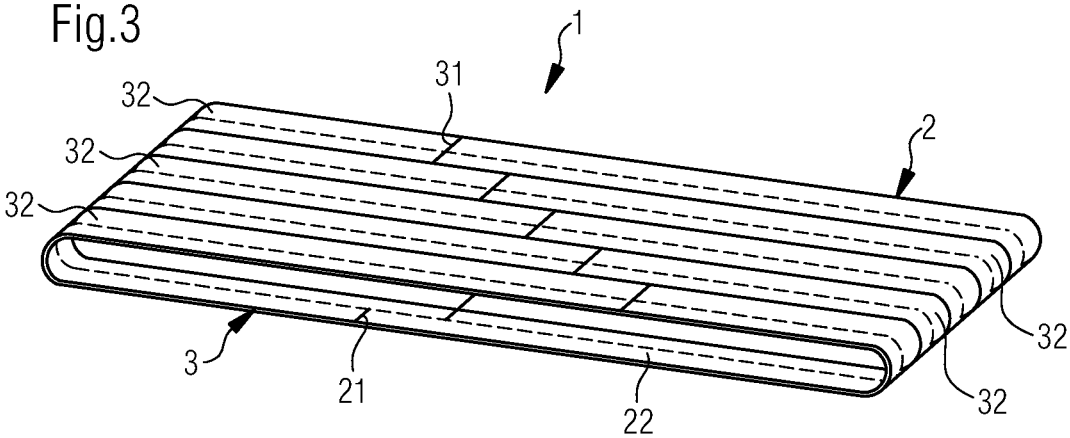
FIG. 3 is a schematic illustration of an endless belt composed of individual components according to the present invention.

Each of the layers may, for example, include a plurality of film-like parts 22 or 32 which are arranged adjacent to each other so that the lateral edges of adjacent parts adjoin each other. A pertinent structure of endless belt 1 is illustrated in FIG. 3. The lateral edges of individual parts 22 and 32 are oriented, for example, parallel to lateral edges 2 and 3 of endless belt 1, so that the individual parts are located next to each other in cross direction QR, in other words transverse to the direction of rotation of endless belt 1. The lateral edges of parts 32 forming outer layer 30, are indicated in the illustration in FIG. 3 by a solid line. Those parts 22 forming inner layer 20 are indicated by a broken line. Butt joints 31 of individual parts 32 in the embodiment illustrated in FIG. 3, as well as butt joints 21 of individual parts 22 are offset in the direction of rotation of endless belt 1. However, this is not absolutely necessary. Rather, all butt joints of one layer can be arranged next to one another, that is at the same level relative to direction of rotation LR, whereby however the butt joints in one layer are arranged relative to direction of rotation of the belt offset to those in the other layer, so that butt joints of different layers are not arranged one above the other in the vertical direction. In an additional embodiment, butt joints of one layer can be arranged relative to direction of rotation LR at the same level with butt joints of the other layer if they are located at a distance from each other relative to the cross direction of belt 1.

In a deviation from the illustration in FIG. 3 of endless belt 1, two or more parts 32 or 22 can moreover be arranged one after another in direction of rotation LR. As is the case in the previously described embodiments, consideration must be given also in such an embodiment in regard to a high tear strength of clothing 10, that the butt joints in one of the layers do not adjoin butt joints in the respective other layer. With several layers it is advisable not to arrange a butt joint of one layer vertically above or below a butt joint of another layer.

Figure 4:
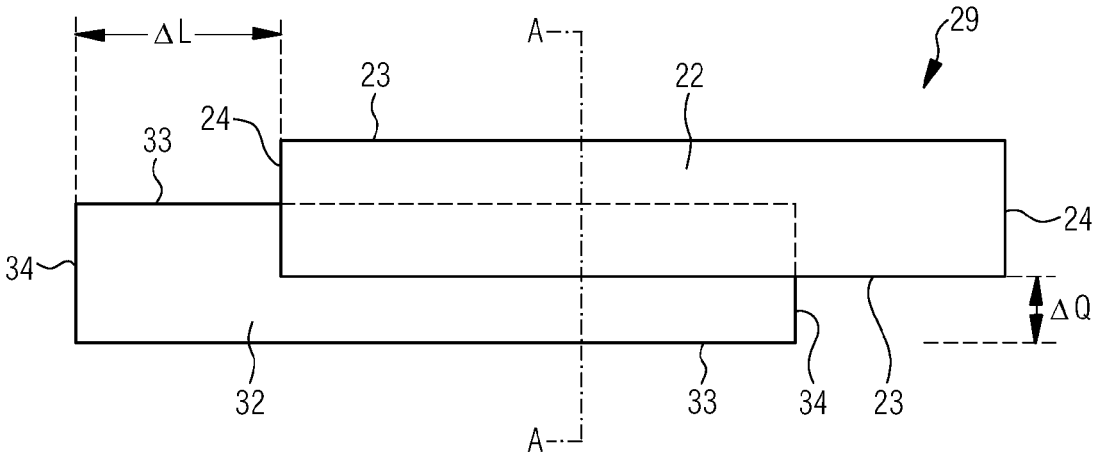
FIG. 4 is a schematic illustration of a top view onto one embodiment of a semi-finished product for the manufacture of an endless belt according to FIG. 3.
Figure 5:
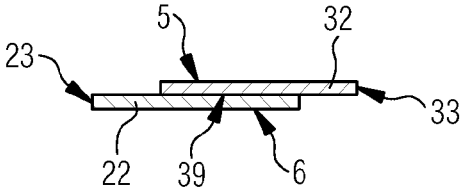
FIG. 5 is a schematic illustration of a cross section through the semi-finished product of FIG. 4.

Referring now to FIG. 4, there is shown a top view of a semi-finished product 29 for the manufacture of endless belt 1 which is assembled from several parts 22 and 32. FIG. 5 illustrates a cross section through the semi-finished product 29 of FIG. 4, along line A-A. Illustrated semi-finished product 29 includes two parts 22 and 32 having the same length and the same width which are arranged on top of one another at a lateral offset. The amount of the lateral offset in direction of travel LR of endless belt 1 is ΔL; that in cross direction QR of endless belt 1 is ΔQ. The edges of part 22 located below and covered by part 32 are indicated by broken lines in the illustration in FIG. 4. To produce semi-finished product 29, two parts 22 and 32 are materially joined with each other at contact surface 39. The width of parts 22 and 32 is, for example between approximately 10 centimeters (cm) and one meter. The widths are for example, greater than 30 cm, or greater than 50 cm. The length of ribbon-shaped parts 22 and 32 is not limited and conforms to the rotational length of endless belt 1 which is to be produced. Material thicknesses, may be in a range of approximately 150 to 500 micrometers (μm), or approximately 300 μm, so that parts 22 and 32 are in a film-like form.

Figure 6:
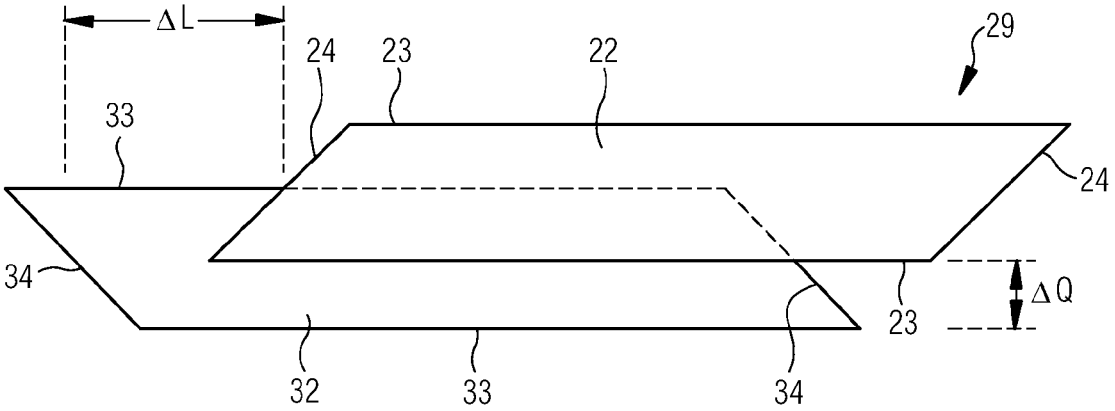
FIG. 6 is a schematic illustration of a top view onto an additional embodiment of a semi-finished product for the manufacture of an endless belt according to FIG. 3.

In the embodiment of a semi-finished product illustrated in FIG. 4, end edges 24 and 34 of parts 22 and respectively 32 are oriented parallel to cross direction QR of endless belt 1 which is to be produced. In other embodiments the end edges progress at an angle of up to 45° transverse to cross direction QR. An accordingly inclined position of the end edges can be provided not only in regard to cross direction QR, but also with respect to the vertical direction of layers 20 and 30. Whereas the end edges of part 22 or respectively 32 are always arranged parallel to each other, the inclined position of the end edge of one part can deviate from that of the other part. An example for this is illustrated in FIG. 6. In this drawing, contact surface 39 at which parts 22 and 32 are materially joined with each other is also shown by hatched lines.

Figure 7:
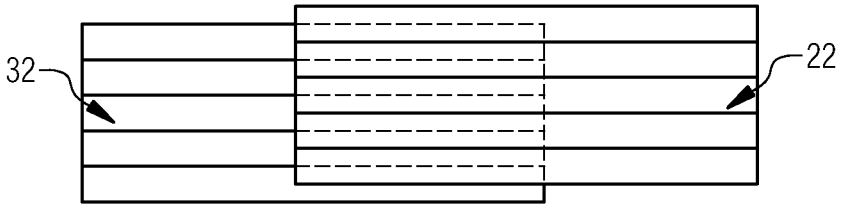
FIG. 7 is a schematic illustration of a top view of one arrangement of semi-finished products for the manufacture of an endless belt according to the present invention.
Figure 8:
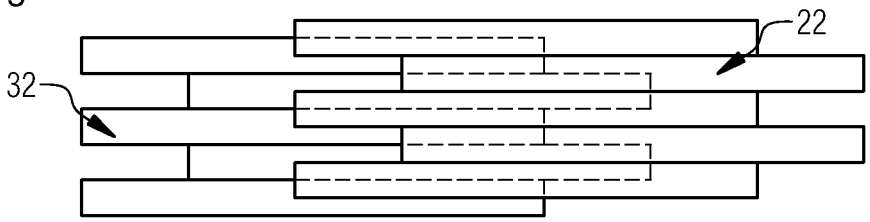
FIG. 8 is a schematic illustration of a top view of another arrangement of semi-finished products for the manufacture of an endless belt according to the present invention.

To produce an endless belt a plurality of semi-finished products 29 are placed with their lateral edges 23 and 33 adjacent to each other so that a closed surface is created on the top side as well as on the underside of the arrangement. Then, the adjoining surfaces of parts 22 and 32 which are not already part of contact surface 39 are materially joined with each other. FIG. 7 illustrates an accordingly produced belt. Parts 32 of the upper layer are shown therein with solid lines, parts 22 of the lower layer with broken lines. If the length of parts 22 and 32 is consistent with the length of endless belt 1 which is produced therefrom, then ends 24 or respectively 34 of the parts are butt joined before the surface region of parts 22 and 32 which are placed hereby on top of one another are joined with each other. In order to avoid a continuous joint location in one or both layers 20 or 30, semi-finished products 29 can be arranged offset relative to each other in direction of travel LR. The offset may be selected to be continuous as illustrated in FIG. 3, or alternating as illustrated in FIG. 8.

Figure 9:
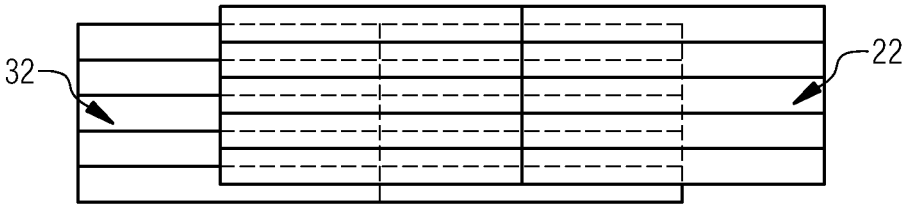
FIG. 9 is a schematic illustration of a top view of an additional arrangement of semi-finished products for the manufacture of an endless belt according to the present invention.
Figure 10:
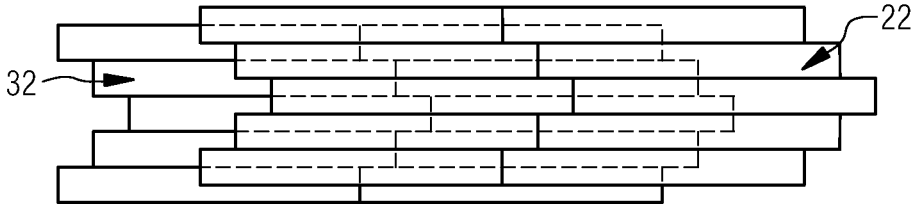
FIG. 10 is a schematic illustration of a top view of an arrangement of semi-finished products for the manufacture of an endless belt, deviating from the illustration in FIG. 9.

If the endless belt which is to be produced is longer than parts 22 and 32 which are used for its manufacture, then not only two or more semi-finished products are placed together in cross direction QR of the endless belt, but also two or more semi-finished products are adjoined in direction of travel LR of the endless belt. FIG. 9 illustrates one possible example for this. Obviously, semi-finished products which are arranged next to one another in cross direction QR in such embodiments can also be arranged offset to one another in direction of travel LR. FIG. 10 illustrates one of the possible embodiment of this.

As the material for forming layers 20 and 30 a flat substrate may be used which is formed on the basis of polyethylene terephthalate (PET), polyethylene-naphthalate (PEN), polyphenylene sulfide (PPS), polyetheretherketone (PEEK), polyamide (PA) or polyolefins. The flat substrate may be single layered or may be multi-layered and formed for example using co-extrusion. To select certain material characteristics, additives may be added to the base materials, for example for hydrolysis protection to improve the light resistance and temperature resistance, or for the creation of certain surface energies of the layer substrates to achieve hydrophobic or hydrophilic characteristics.

To produce parts 22 and 32, flat sheets or roll goods are produced from one of these materials through extrusion or casting which are subsequently drawn uni-directionally in direction of travel LR, or bi-directionally.

Figure 11:
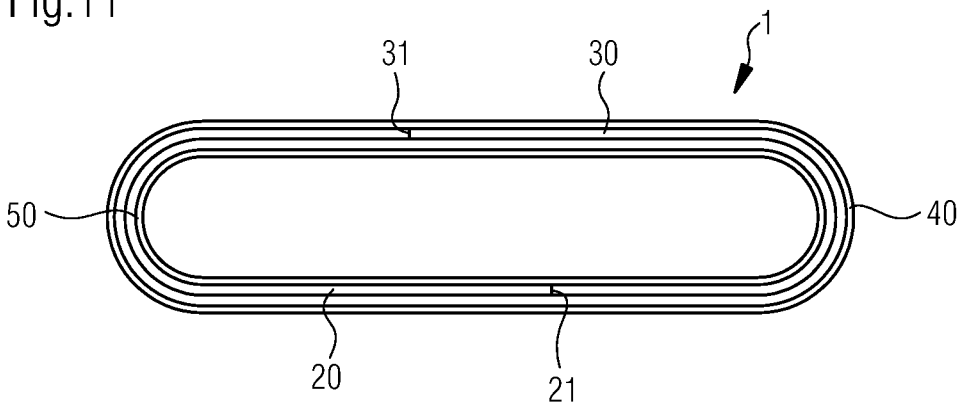
FIG. 11 is a schematic illustration of a cross section through an endless belt with additional layers, produced from semi-finished products according to the present invention.

In addition to two layers 20 and 30, endless belt 1 can have additional layers. For example, an additional polymer layer 40 can cover layer 30 on the paper-side surface. Alternately or in addition, the running-side surface of layer 20 may moreover also be covered with an additional polymer layer 50. A pertinent structure of an endless belt is illustrated in the cross sectional illustration in FIG. 11. Paper-side surface layer 40 is, for example, thinner than layer 30 or 20 and may be formed by one single-piece polymer film. Layer 40 covers butt joints formed at the lateral and end edges of parts 22, and ensures a smooth paper-side surface of clothing 10 even when parts 22 are not joined with each other at the butt joints and could therefore open up under operational pressures. Since surface layer 40 does not have to absorb tensile stresses, the material of this layer can be selected with a view to optimum abrasion resistance. To reduce the abrasion occurring due to passing through the various machine elements, running side 50 can be provided with wear and tear reducing additives, thus being able to achieve higher running performance of clothing 10.

To produce clothing 10 for the forming section, press section or dryer section, holes are introduced into endless belt 10 through which water can be drawn off at the running side of clothing 10 from its paper-side surface.

Clothing 10, for example, has an overall thickness in the range of approximately 400 to 1100 μm. For use in in the forming section or in the dryer section, overall thicknesses in the range of approximately 500 μm to approximately 600 μm may be utilized. Accordingly, parts 22 and 32 having material thicknesses from the range of approximately 200 to approximately 500 μm may be used to produce semi-finished products 29.

The material to material connection of parts 22 and 32 on contact surface 39 in order to manufacture semi-finished product 29 can be produced through ultrasonic welding, high frequency welding, thermal welding or adhesion, or through use of hot-melt adhesives. The bonding occurs, for example, effective over the entire surface, which is to be understood to be a bonding over the entire contact surface, or bonding covering only parts of the contact surface. The latter are hereby distributed over the contact surface in such a way that the surfaces making contact with each other are held together. The material connection between the two parts may for example be realized in the course of the formation of dewatering pores with the assistance of a laser drilling process which will be described later. In this process the film material is melted at the edges of the pore holes, thus producing a material to material connection at the contact surfaces of film parts 22 and 23 which are arranged on top of one another. As a result the two parts 22 and 23 are connected with each other effectively over an area through a plurality of welding regions surrounding the pores.

In an additional embodiment of the present invention, a transmission laser welding process is used, wherein material is melted at contact surface 39 with the assistance of an NIR laser (laser having an emission wavelength in the near infrared range), while pressure is simultaneously being exerted upon the melting region.

In order to only melt the region of contact surface 39 the energy supply into the part being targeted by the laser must be minimal. Therefore, at least one of parts 22 or 32 is formed of a material which practically does not absorb the light being emitted by the laser. If the other part is formed of a laser light absorbing material, then the laser light melts its surface on contact surface 39 which is being irradiated and can be materially joined with the opposite surface of the other part through application of pressure. To ensure a light absorption in the near infrared range, appropriate additives can be added to the starting materials prior to extrusion or casting of the semi-finished products used for the manufacture of one of the sheets, in the simplest case soot.

If both parts are manufactured from a material which does not absorb the laser light, then the surface of at least one of parts 22 or 32 is provided with a thin laser light absorbing coating on the contact side. The contact sides of both parts may moreover also be coated. The absorbent layer absorbs the light of the laser used for welding, thereby melting the adjoining surface regions of both parts 22 and 32 which are arranged one on top of the other. The simultaneous pressure application subsequently causes the material to material bond.

Suitable lasers are, for example, diode lasers having emission wavelengths in the range of between approximately 800 to 980 nanometers (nm) and neodymium-doped yttrium aluminum garnet lasers (Nd: YAG-lasers) having an emission length of approximately 1064 nm. Lasers having emissions in the range of between approximately 940 to 1084 nm are, for example, used.

Figure 12:
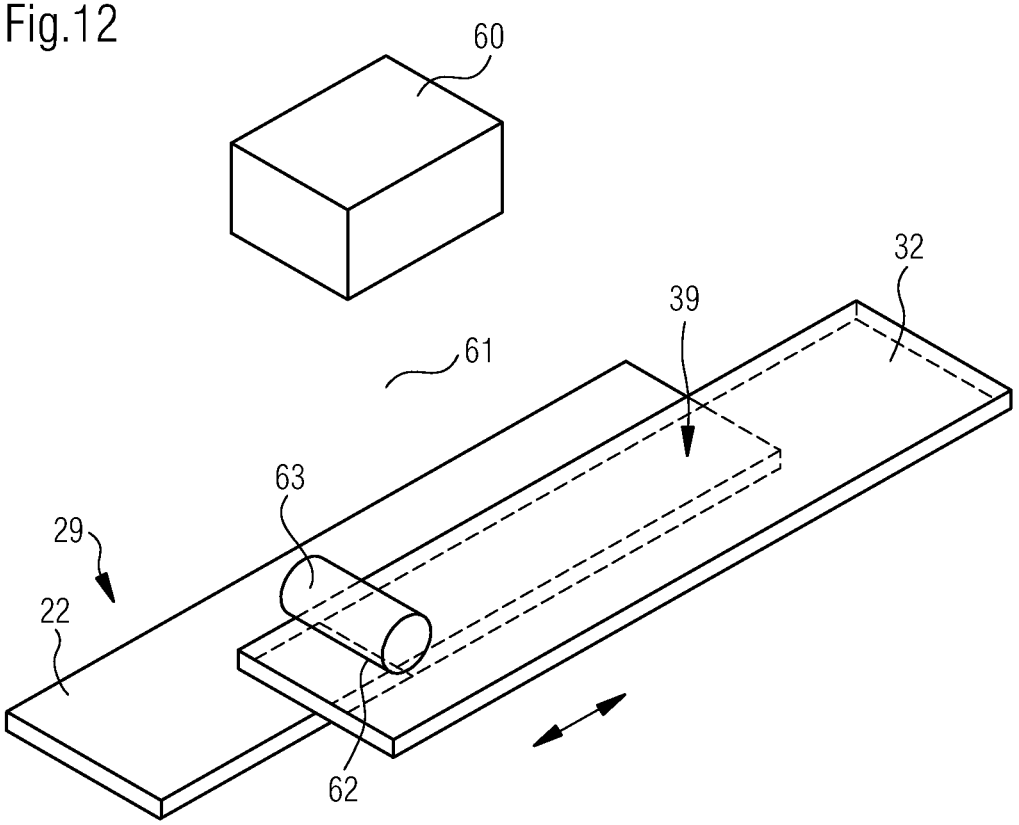
FIG. 12 is a schematic perspective illustration of an arrangement for welding of two parts into one semi-finished product according to the present invention.

The schematic illustration in FIG. 12 shows an arrangement for welding of parts 22 and 32 at contact surface 39. Fan-shaped light beam 61 emitted from laser 60 is converged linearly onto contact surface 39 via a roll 63 which is transparent for the used wavelength, through the material of upper part 32 which is transparent for the laser light. The thus concentrated laser energy is absorbed on contact surface 39 in the region of line 62 and is converted into thermal energy. The transparent roll presses onto the surface of upper part 32 with a predetermined force, so that the two parts 22 and 32 are pressed together in the region of linear melting zone 62. Through moving parts 22 and 32 relative to the radiation configuration formed by laser 60 and transparent pressure roll 63, both parts are materially joined in the region of contact surface 39. The movement may be implemented by moving of parts 22 and 32 which are accommodated in a holding device, as well as through moving of the radiation configuration.

Only one thin surface region is melted with the described laser welding method. The temperatures below or above melting zone 62 are always lower than the glass transition temperature of the welded polymers, so that the structural integrity of parts 22 and 32 is not impaired by the welding process. A possible melting through laser beam 61 of surface regions adjoining contact surface 39 has no negative effects, since no distortions can occur on the surfaces due to the very thin melting zone. These surface area regions can moreover be melted again during the subsequent welding together of a plurality of semi-finished products 29 to an endless belt 1 while they are simultaneously being pressed against the surface of another part. Possibly occurring changes at the surface area regions are hereby equalized. Consequently, when using an absorber coating a somewhat larger area than contact surface 39 can be coated. Since many of the current absorber coatings lose their infrared absorption capacity during melting, the absorber coating should be reapplied repeatedly onto the remaining surface of one of parts 22 or 32 which is located outside contact surface 39, either after welding together of parts 22 and 32 into a semi-finished product 29 or, in the event that the surface was coated in its entirety on contact surface 39 prior to welding, at least onto the possibly melted edge regions around contact surface 39.

Lateral offset $\Delta Q$ in the cross direction of ribbons 22 and 32 is approximately between 10 and 80% of the width of the ribbons in order to obtain sufficiently large areas for a secure bond of layers 20 and 30. According to one embodiment an offset of approximately 50% of the parts width is utilized, thereby creating an equally strong bond on both sides of the longitudinal edges. If the width of ribbons 20 and 30 are consistent with the width of the endless belt produced from them, then no offset is necessary between the two ribbons. The lateral offset $\Delta L$ in the direction of travel of ribbon-like parts 22 and 32 analogically is between 5 and 95% of the parts' lengths, whereby an offset of approximately 50% is feasible if the length of parts 22 and 32 is consistent with the length of rotation of endless belt 1.

In order to also materially weld together with adjoining lateral edges of parts 22 and 32 of an endless belt 1, lateral edges 23, 33, 24 and 34 of semi-finished products 29 are coated with an absorber layer prior to placing them side by side. In order to obtain a secure material bond of the side edges, fan-shaped laser beam 61 can be targeted during joining of semi-finished products 29 to an endless belt 1—other than shown in FIG. 12—not vertical but diagonally onto the surfaces of semi-finished products 29, thus achieving a surface illumination and therefore surface melting of the contact region of the lateral edges. The laser beam is, for example tilted for this purpose in cross direction QR as well as in running direction LR, so that end edges 24 and 34 as well as longitudinal lateral edges 23 and 33 are welded together. Since semi-finished products 29 are formed of a flexible polymer material, the lateral edges are also pressed together through the pressure of transparent roll or roller 63, and are thereby securely bonded. In order to ensure that also the lateral edges of the lower layer are securely welded together, the process can be repeated on the underside of the endless belt. In order to avoid renewed melting of the contact surfaces between layers 20 and 30 an absorber coating may be used which varies its infrared absorption capability after the first melting process. Instead of targeting the infrared light slanted onto vertical lateral edges, the lateral edges can be slanted relative to the vertical direction of endless belt 1, thereby enabling a vertical radiation.

As an alternative to laser welding, emitting broadband radiators, for example quartz radiators, can be used in the near infrared range of between approximately 700 to 1200 nm. The wavelength range of the light targeting the welding regions is, for example, coordinated to the absorber characteristics by use of filters.

Instead of with an IR-laser or IR-radiator, the lateral edges can also be welded with the assistance of a mono-filament, filled with a resin or bonded with a hot melt adhesive.

Figure 13:
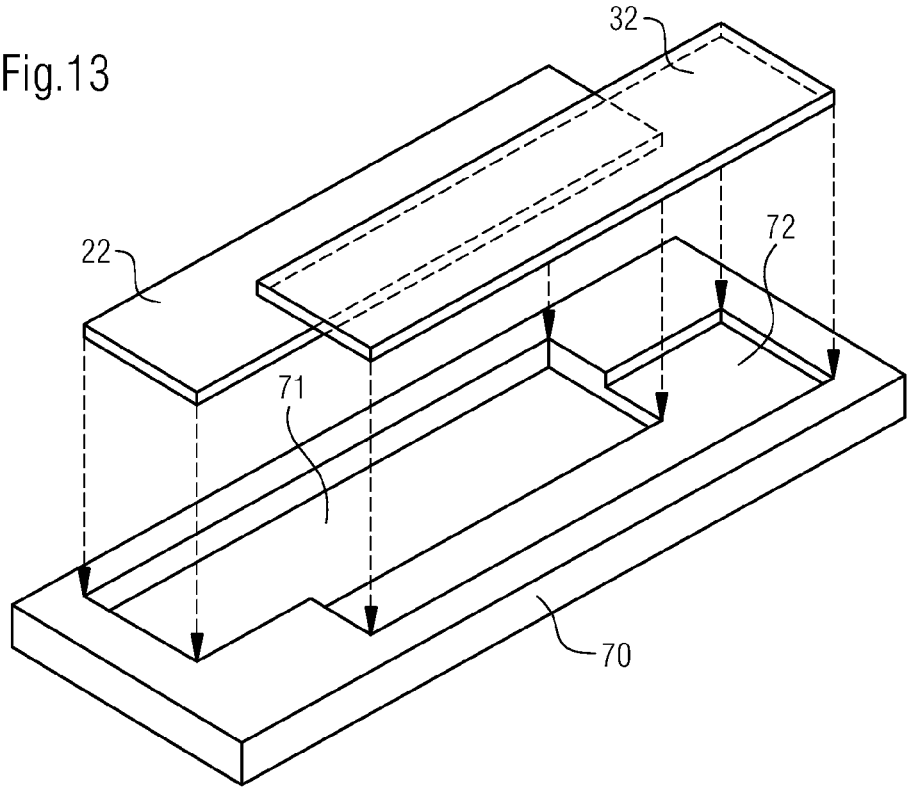
FIG. 13 is a schematic perspective illustration of a retaining device to accommodate parts for the production of semi-finished products according to the present invention.

To ensure that the edges of adjacent parts 22 and 32 directly adjoin each other during the manufacture of endless belt 1 from semi-finished products 29 which were produced as described, the lateral dimensions of the individual parts 22 and 32 as well as the size and location of contact surfaces 39 must be exactly the same on all semi-finished products. In order to ensure this a holding device may be used, in which parts 22 and 32 are held in a fixed position relative to each other during the welding process. An example for such a holding device is schematically illustrated in FIG. 13. Holding device 70 has two recesses 71 and 72 in the embodiment of a negative form of semi-finished product 29. For easy placement of parts 22 and 32 into recesses 71 and 72, as well as for easier removal of the completed semi-finished product 29 from form 70, holding device 70 can be provided with recessed grips adjacent to recesses 71 and 72 (not shown in the drawing). To protect the corners of semi-finished product 29, a hole can be superimposed on the corners of the recesses. The dash-dotted arrow lines indicate placement of parts 22 and 32 in holding device 70 in the drawing.

In another method of manufacturing the clothing according to the present invention, the length of ribbons 22 and 23 is several times that of the length of rotation of endless belt 1 being produced therefrom. In one first process step, the two ribbons are connected with each other with a lateral offset. This may occur for example in a continuous process wherein ribbons 22 and 32, which are arranged on top of one another, are guided between two interacting rolls. One of the two rolls is transparent roll 63 illustrated in FIG. 12 through which the laser light is brought into the overlap region of the two ribbons.

Figure 14:
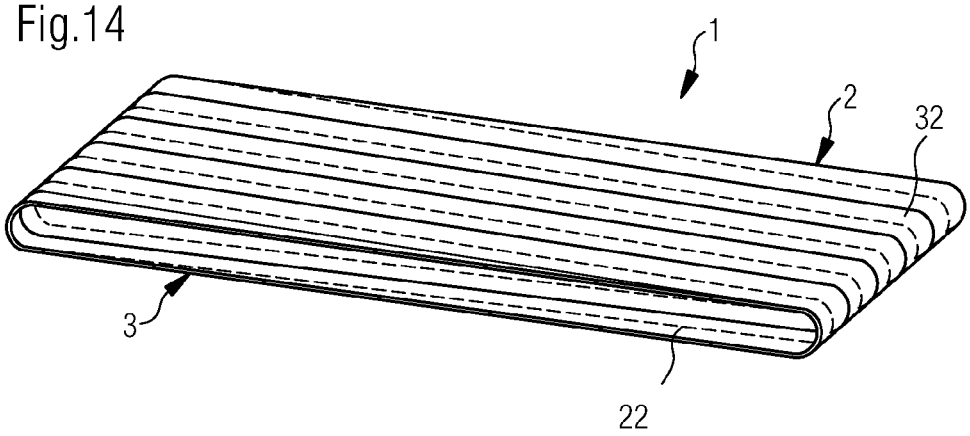
FIG. 14 is a schematic illustration of an endless belt, joined together from a spirally wound ribbon according to the present invention.

The created profile ribbon is subsequently spirally wound as shown in FIG. 14 so that lateral edges which are located opposite each other make contact. The lateral edges are subsequently welded together, for example in a transmission laser welding process as previously described, whereby in the case of vertical lateral edges the laser beam is directed, for example slanting into the lateral edges; in contrast vertically, in the case of slanted lateral edges relative to the vertical direction of belt 1. Finally, the edges of endless belt 1 are seamed as in the above production methods; in other words they are cut or trimmed according to the desired with of endless belt 1.

Figure 15:
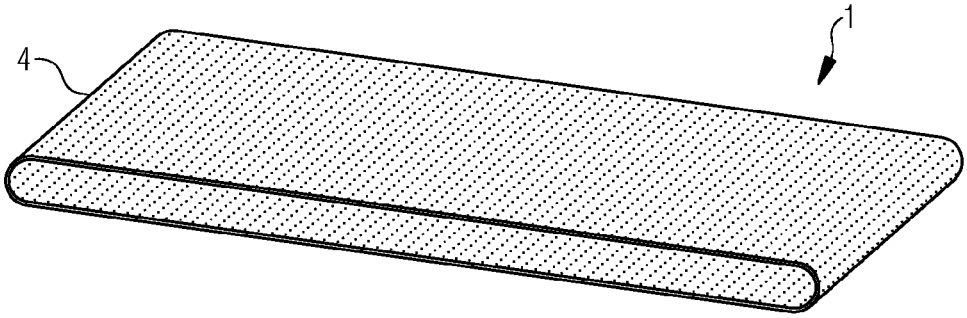
FIG. 15 is a schematic illustration of an endless belt equipped with holes according to the present invention.

The water permeability of clothing 10 is adjusted as schematically illustrated in FIG. 15, by introduction of holes into endless belt 1, for example using a laser drill. The number of holes 4 shown in the drawings was selected with a view to clarity of the illustration and, as is also the case in regard to the size of the holes, is not representative of the actual situation. The holes are generally approximately 100 μm to several hundred micrometers in size and are also arranged at distances from each other within this dimensional range.

So that the clothing does not shrink during operation, which is to be understood to be a shortening of rotational length and width of belt 1 due to thermal influences, the clothing is subsequently heat-set.

The joint locations where local changes in the polymer structure may occur are distributed in the described clothing 10 in such a way, that they are always supported by regions having an unchanged polymer structure. This ensures that the tensile stresses occurring in intended use of the clothing are completely absorbed from undisturbed regions of the clothing, thus avoiding wrinkle formation and achieving a high longitudinal strength of the clothing.

Figure 16:
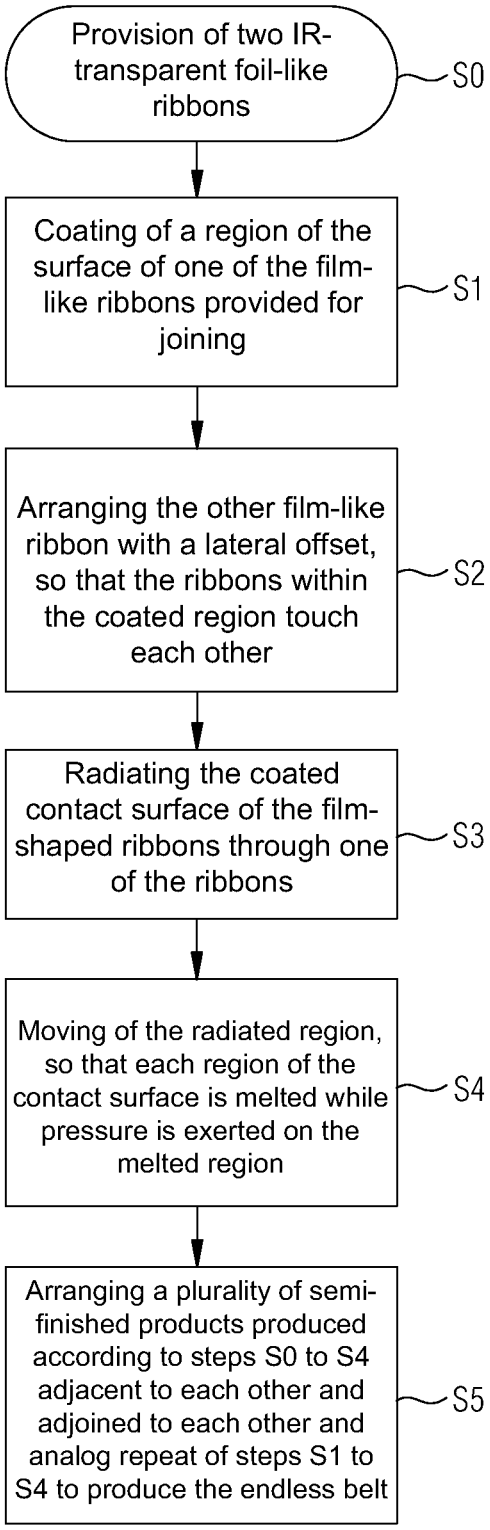
FIG. 16 is a chart of the steps of a method to produce an endless belt from a plurality of film-like ribbons according to the present invention.

Referring now to FIG. 16, there is summarized the general steps of an inventive method for the production of an endless belt 1 as previously described. In step S0 two film-like ribbons 22 and 32 having the same length and width are provided. The ribbons are transparent for light in a specific wavelength range in the near infrared, in other words within a range selected from the range of 800 to 1100 nm. In the following step S1 a coating is applied onto the surface of one of ribbons 22 or 32. The coating absorbs light from the specific wavelength range. Subsequently in step S2, second film-like ribbon 32 is arranged on first film-like ribbon 22 with a lateral offset in such a way that the two ribbons are in contact with each other within the coated region. In following step S3, laser light 61 is irradiated through one of the film-like ribbons onto the coating in the overlap region of the two ribbons, whereby the wavelength of the laser light is consistent with a wavelength which can be absorbed by the coating. The laser light radiated onto the coating is directed in step S4 so that each region of contact surface 39 which is formed between ribbons 22 and 32 is melted while pressure is simultaneously exerted upon the melting region. Finally in step S5, a plurality of film-like ribbons which were joined according to the preceding steps, is arranged side by side adjoining one another and through analog application of steps S1 to S4 are joined to an endless belt 1.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A clothing for a paper machine arranged as an endless belt, the clothing comprising:

at least one first layer; and at least one second layer arranged on said at least one first layer and an entire surface of said at least one second layer bonded with said at least one first layer, said first layer and said second layer each being formed by one film-like ribbon or a plurality of film-like ribbons arranged adjacent to each other and adjoined to one another in a direction transverse to a direction of rotation, said film-like ribbons each having a pair of opposing lateral edges and a pair of opposing end edges, wherein:

adjoining said lateral edges of two of said film-like ribbons of said first layer or said second layer are arranged between opposing lateral edges of one of said film-like ribbons of the other of said first layer and said second layer;

adjoining said end edges of said film-like ribbons of said first layer or said second layer are arranged between said end edges of said film-like ribbons of the other of said first layer and said second layer; and said film-like ribbons of said first layer or said second layer being bonded over an entire surface with said film-like ribbons of the other of said first layer and said second layer, wherein said plurality of film-like ribbons are formed of a polymer drawn uni-directionally in a direction of rotation of the clothing or a bidirectionally drawn polymer.

2. The clothing according to claim 1, wherein said film-like ribbons of said first layer or said second layer are materially joined with said film-like ribbons of said other of said first layer and said second layer.

3. The clothing according to claim 1, wherein at least one of said adjoining lateral edges and said adjoining end edges of said film-like ribbons are material joined.

4. The clothing according to claim 1, further comprising a third layer applied to a paper-side surface of said first layer and said second layer, said third layer having a thickness less than a thickness of said first layer.

5. The clothing according to claim 4, said third layer having a thickness less than said second layer.

6. The clothing according to claim 5, further comprising a fourth layer applied to a running-side surface of said first layer and said second layer.

7. The clothing according to claim 6, wherein at least one of said third layer and said fourth layer includes a plurality of material characteristic-determining additives.

8. A clothing for a paper machine arranged as an endless belt, the clothing comprising:

at least one first layer; and at least one second layer arranged on said at least one first layer and an entire surface of said at least one second layer bonded with said at least one first layer, said first layer and said second layer each being formed by one film-like ribbon or a plurality of film-like ribbons arranged adjacent to each other and adjoined to one another in a direction transverse to a direction of rotation, said film-like ribbons each having a pair of opposing lateral edges and a pair of opposing end edges, wherein:

adjoining said lateral edges of two of said film-like ribbons of said first layer or said second layer are arranged between opposing lateral edges of one of said film-like ribbons of the other of said first layer and said second layer;

adjoining said end edges of said film-like ribbons of said first layer or said second layer are arranged between said end edges of said film-like ribbons of the other of said first layer and said second layer; and said film-like ribbons of said first layer or said second layer being bonded over an entire surface with said film-like ribbons of the other of said first layer and said second layer, wherein a thickness of the clothing is in a range between approximately 300 micrometers (μm) to 1600 μm.

9. The clothing according to claim 8, wherein said thickness of the clothing is in a range between approximately 500 μm to 800 μm.

10. A clothing for a paper machine arranged as an endless belt, the clothing comprising:

at least one first layer; and at least one second layer arranged on said at least one first layer and an entire surface of said at least one second layer bonded with said at least one first layer, said first layer and said second layer each being formed by one film-like ribbon or a plurality of film-like ribbons arranged adjacent to each other and adjoined to one another in a direction transverse to a direction of rotation, said film-like ribbons each having a pair of opposing lateral edges and a pair of opposing end edges, wherein:

adjoining said lateral edges of two of said film-like ribbons of said first layer or said second layer are arranged between opposing lateral edges of one of said film-like ribbons of the other of said first layer and said second layer;

adjoining said end edges of said film-like ribbons of said first layer or said second layer are arranged between said end edges of said film-like ribbons of the other of said first layer and said second layer; and said film-like ribbons of said first layer or said second layer being bonded over an entire surface with said film-like ribbons of the other of said first layer and said second layer, wherein said plurality of film-like ribbons are formed from a material selected from one of polyethylene terephthalate (PET), polyethylene-naphthalate (PEN), polyphenylene sulfide (PPS), polyetheretherketone (PEEK), polyamide (PA), and polyolefins.

* * * * *